US009205485B2

(12) United States Patent
Johansen et al.

(10) Patent No.: US 9,205,485 B2
(45) Date of Patent: Dec. 8, 2015

(54) MOULDING CHAMBER ARRANGEMENT FOR A MOULD-STRING PLANT

(75) Inventors: Jørn Johansen, Herlev (DK); Rahlf Henning Nielsen, Herlev (DK)

(73) Assignee: DISA INDUSTRIES A/S, Herlev (DK)

( * ) Notice: Subject to any disclaimer, the term of this patent is extended or adjusted under 35 U.S.C. 154(b) by 572 days.

(21) Appl. No.: 13/574,074

(22) PCT Filed: Jan. 25, 2011

(86) PCT No.: PCT/IB2011/050321

§ 371 (c)(1),
(2), (4) Date: Mar. 11, 2013

(87) PCT Pub. No.: WO2011/089585

PCT Pub. Date: Jul. 28, 2011

(65) Prior Publication Data

US 2013/0161862 A1 Jun. 27, 2013

(30) Foreign Application Priority Data

Jan. 25, 2010 (WO) ..... PCT/IB2010/050319

(51) Int. Cl.
*B29C 37/00* (2006.01)
*B22C 11/10* (2006.01)
*B22C 9/20* (2006.01)

(52) U.S. Cl.
CPC . *B22C 11/10* (2013.01); *B22C 9/20* (2013.01); *B29C 37/005* (2013.01)

(58) Field of Classification Search
CPC ..... B22C 9/20; B22C 11/00; B22C 11/10; B22C 11/12
USPC ..... 164/322, 327, 328, 329, 330, 182, 187; 249/158, 155; 425/195, 193; 264/219
See application file for complete search history.

(56) References Cited

U.S. PATENT DOCUMENTS 3,654,986 A 4/1972 Jansen
3,695,339 A * 10/1972 Taccone ..... 164/213

(Continued)

FOREIGN PATENT DOCUMENTS

| | | |
|---|---|---|
| FR | 2 196 865 | 3/1974 |
| WO | WO 01/70432 | 9/2001 |
| WO | WO 2009/074838 | 6/2009 |

OTHER PUBLICATIONS

International Search Report for PCT/IB2011/050321 Dated May 30, 2011.

(Continued)

*Primary Examiner* — Nahida Sultana
(74) *Attorney, Agent, or Firm* — Marvin Petry; Stites & Harbison PLLC

(57) ABSTRACT

Molding chamber arrangement (1) for a mold-string plant comprising a molding chamber (2) formed by a chamber bottom (3), a chamber ceiling (4) provided with one or more sand filling openings (22) communicating with a sand-feed system (14), two chamber side walls (5), a pressure plate (6) provided with an exchangeable pressure pattern plate having a pressure pattern (8) and being connected to a movement mechanism (9), a swingable plate (10) provided with an exchangeable swing pattern plate having a swing pattern (12) and being mounted for translational and swinging movement in order to open and close the molding chamber (2), allowing the pressure plate (6) to expel the produced molds, and further comprising means (13) for vertically moving the chamber ceiling (4) and sand-feed system (14) in unison, or the chamber bottom (3), or both, relative to the remainder of the molding chamber arrangement (1), thereby changing the height of the molding chamber. By this arrangement, the flexibility of the size of the produced molds, especially the heights of the produced molds, can be adjusted without changing the geometry of the sand feed system above the molding chamber in a time-saving manner.

27 Claims, 7 Drawing Sheets

(56) References Cited

U.S. PATENT DOCUMENTS

| | | | | |
|---|---|---|---|---|
| 4,437,507 | A | 3/1984 | Seeley | |
| 4,657,064 | A * | 4/1987 | Hunter | 164/169 |
| 5,879,721 | A * | 3/1999 | Bradley | 425/218 |
| 6,463,993 | B1 | 10/2002 | Cle Nogueras et al. | |
| 2004/0060686 | A1* | 4/2004 | Sorensen | 164/200 |
| 2008/0135205 | A1* | 6/2008 | Jezwinski | 164/456 |
| 2013/0118702 | A1* | 5/2013 | Oya et al. | 164/37 |

OTHER PUBLICATIONS

Written Opinion of the International Searching Authority for for PCT/IB2011/050321 Dated May 30, 2011.

International Preliminary Report on Patentability for for PCT/IB2011/050321 Dated Jul. 7, 2011.

* cited by examiner

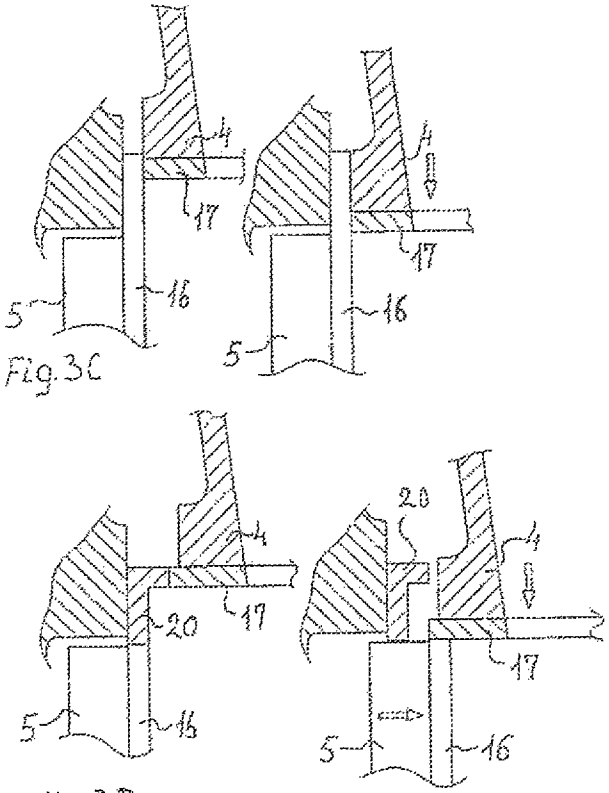
Fig.3C
Fig.3D
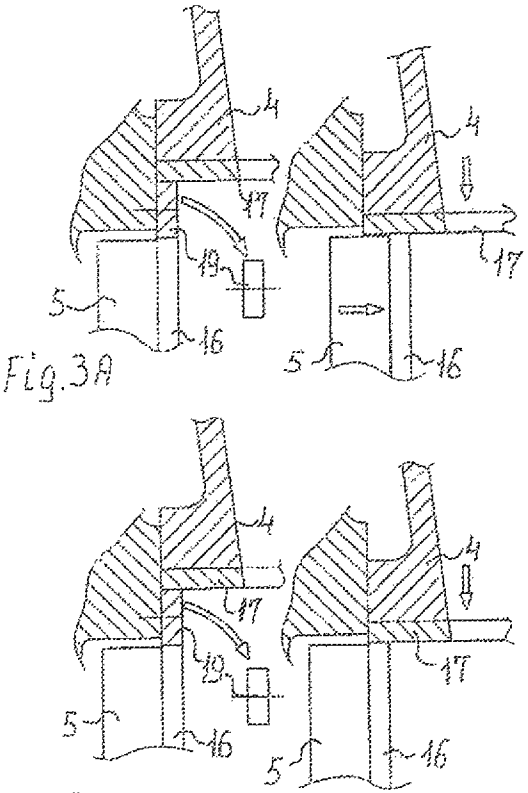
Fig.3A
Fig.3B

MOULDING CHAMBER ARRANGEMENT FOR A MOULD-STRING PLANT

TECHNICAL FIELD

The present invention relates to a moulding chamber arrangement for a mould-string plant of the kind set forth in the preamble to claim 1.

BACKGROUND ART

In moulding chambers for mould-string plants of this kind it is known to provide variable sizes of the moulding chamber by making the side walls of the moulding chamber movable and adjusting the positioning of the side walls by means of a hydraulic system. A moulding chamber of this type is known from EP 1 149 645 A1. A problem with a moulding chamber of this type is that it is not possible to use pattern plates that vary in the height.

Furthermore, WO 2009/074838 discloses a moulding chamber arrangement for a mould-string plant, in which a variable size of the moulding chamber is provided by using adaptor plates for reducing the size of the moulding chamber. In connection with reduction of the height of the moulding chamber, the insertion of an adaptor plate on the upper wall of the moulding chamber increases the distance between the sand feed system and the moulding chamber, whereby the sand flow into the moulding chamber will be affected unfavourably. Moreover, it is very laborious and time consuming to insert or remove adaptor plates in the chamber ceiling because it requires the movement of very heavy components (adaptor plates of the above mentioned kind weigh several hundreds of kg), and inevitable residue deposits of sand in the sand feed system will also leak into the moulding chamber during the insertion or removal of the adaptor plates.

Additionally, FR 2 196 865 discloses a sand moulding machine wherein sand moulds are formed by pressing pattern plates toward each other. After the sand moulds are formed the top plate is raised so that the sidewalls can tilt slightly and therefore not stick to the sand mould when it is being expelled from the form chamber. Thus, even though the top plate is movable vertically, the form chamber in which the sand moulds are formed is not altered in size, and therefore in particular not in the vertical direction. Accordingly, the volume of the form chamber is not altered.

U.S. Pat. No. 3,654,986 discloses a type of sand moulding machines that operates according to the so-called match plate principle, which employs match plates and flasks. The disclosed machine is equipped with a height adjustable receiver table, which receives the finished moulds and levels them with a conveyor. The moulding chamber itself is not changed in size by the movement of the receiver table.

DISCLOSURE OF THE INVENTION

It is thus an object of the present invention to provide a moulding chamber arrangement of the kind referred to above, by which it is possible to provide an increased flexibility of the size of the produced moulds in a way that does not adversely affect the sand flow into the moulding chamber, and which is quickly to adjust, in particular in the height, with a minimum of manual work.

This and further objects is achieved with a moulding chamber arrangement for a mould-string plant comprising: a moulding chamber formed by a chamber bottom, a chamber ceiling provided with one or more sand filling openings communicating with a sand feed system, two chamber side walls, a pressure plate provided with an exchangeable pressure pattern plate having a pressure pattern and being connected to a movement mechanism, a swingable plate provided with an exchangeable swing pattern plate having a swing pattern and being mounted for translational and swinging movement in order to open and close the moulding chamber, allowing the pressure plate to expel the produced moulds. The moulding chamber arrangement further comprises means for vertically moving the chamber ceiling and sand-feed system in unison, or the chamber bottom, or both, relative to the remainder of the moulding chamber arrangement, thereby changing the height of the moulding chamber.

Since this arrangement comprises means for vertically moving the chamber ceiling and sand-feed system in unison, relative to the remainder of the moulding chamber arrangement, it is possible to vary the heights of the moulds without changing the geometry of the sand feed system above the moulding chamber. It is thus possible to vary the height of the sand moulds without adversely affecting the inflow of sand into the moulding chamber during the formation of the moulds.

By the geometry of the sand feed system is meant any of the following process parameters: The angle of the sides of the funnel, the height of the funnel, the size, especially the height, and form of the sand-filling opening, Furthermore, there are provided a number of air exhaust nozzles in the chamber ceiling of the moulding chamber in order to ensure that air can escape from the moulding chamber while it is being filled with sand. The geometry, number, and placement of these air exhaust nozzles are also critical process parameters.

Since the inventive arrangement comprises means for vertically moving the chamber ceiling and sand-feed system in unison, relative to the remainder of the moulding chamber arrangement, it is possible to vary the heights of the moulds without changing any of these critical processing parameters.

By providing means for vertically moving the chamber ceiling and sand-feed system in unison, relative to the remainder of the moulding chamber arrangement, a very time-saving shift in the production of sand moulds having different sizes is achieved as compared to the laborious exchange of adaptor plates in the ceiling of the moulding chamber known in the prior art.

Since the geometry of the chamber ceiling and sand-feed system needs to be unchanged in order to obtain an optimal running in the production line; the only alternative to this is a complete rebuilding of the top of the machine, which would require a long and complicated rearrangement of rather heavy equipment, and it would therefore not be a flexible and economically favorable solution.

In a preferred embodiment, the arrangement further comprises means for changing the horizontal extension of the moulding chamber in the direction between the two chamber side walls. Hereby is achieved an arrangement wherein both the height and width of the moulding chamber may be adjusted to the needs of the user.

This is a tremendous practical advantage because most standard pattern plates are manufactured in a number of standard sizes that vary in height as well as in width, and many manufacturers hold many (often several thousands) such different pattern plates, and since these pattern plates are rather expensive to manufacture, it is a huge advantage that they all can be used or re-used in a moulding chamber arrangement according to the invention. For example, it is common practice to use the so called A and B pattern plates, which are used in sand moulding machines manufactured by DISA. The A plate has a width of 600 mm and a height of 480 mm, while the B plate has a width of 650 mm and a height of 535 mm. Thus, a moulding chamber arrangement that can only be adjusted in the height or the width cannot be used together with both of these types of pattern plates.

Accordingly, a highly flexible moulding chamber arrangement is provided, which at the same time eliminates some of critical disadvantages of the prior art systems.

According to an embodiment of the moulding chamber arrangement, the means for changing the horizontal extension of the moulding chamber in the direction between the two chamber side walls comprises mounting of one or two side wall wear plates. Preferably, the means for changing the horizontal extension of the moulding chamber in the direction between the two chamber side walls comprises one or two side wall wear plates. This provides a convenient way of adjusting the horizontal extension of the moulding chamber between the two chamber side walls. The side wall wear plates are manually mounted using conventional mounting means.

An alternative embodiment of a moulding chamber arrangement according to the invention may furthermore comprise two side wall wear plates, and the means for changing the horizontal extension of the moulding chamber in the direction between the two chamber side walls may comprise means for changing the distance between the two side wall wear plates. These means could for example be manually operated means, e.g. means for manually moving the side wall wear plates using guide rods and fixing means like bolts and nuts.

In a further alternative embodiment according to the invention, the means for changing the horizontal extension of the moulding chamber in the direction between the two chamber side walls may comprise the mounting of one or two side adaptor plates. These adaptor plates are preferably placed on the chamber side walls behind a wear plate, so that only the wear plate will be in direct contact with the sand moulds. In this way a cheaper and easier way of adjusting the width of the moulding chamber is provided, because while a wear plate has to be manufactured of a material having some very special properties, there are less strict requirements for the adaptor plates, because they are not directly exposed to the sand in the moulding chamber.

A yet further embodiment of a moulding chamber arrangement in accordance with the invention may comprise several sets of side adaptor plates, each set providing an individual reduced horizontal extension of the moulding chamber in the direction between the two chamber side walls.

Alternatively, the moulding chamber arrangement for a mould-string plant in accordance with an embodiment of the invention may comprise several sets of side wall wear plates, each set providing an individual reduced horizontal extension of the moulding chamber in the direction between the two chamber side walls.

In a preferred embodiment of a moulding chamber arrangement in accordance with the invention, the means for changing the distance between the two chamber side wall wear plates may comprise at least one side adaptor plate adapted to be mounted on at least one of the chamber side walls of the moulding chamber, preferably two adaptor plates of equal thickness for mounting on each of the two chamber side walls, the side wall wear plates being mounted on said adaptor plates. By providing two adaptor plates of equal thickness behind a wear plate, a symmetrical reduction of the width of the moulding chamber is achieved, thereby precluding axis stress on the piston means that drives the press plate.

In another preferred embodiment of a moulding chamber arrangement the means for changing the distance between the two side wall wear plates comprises moving means for horizontally moving the chamber side walls and side wall wear plates. These moving means may comprise a manually adjustable spindle, guide rods and fastening bolts or other manually adjustable movement means, such as a spindle or a rack pinion.

Preferably, the swing pattern and pressure pattern mounting plates have dimensions adapted to the possible reduced sizes of the moulding chamber.

In another embodiment the moulding chamber arrangement may further comprise means for closing the possible gaps between the chamber side walls and/or chamber ceiling and chamber bottom.

Said means for closing the possible gaps between the chamber side walls and/or chamber ceiling and chamber bottom may comprise loose inserts and/or fixed extensions of wear plates.

A preferred embodiment of a moulding chamber arrangement in accordance with the invention may further comprise means for fixating the movable parts of the moulding chamber in the intended use positions.

The above mentioned and further objects of the invention are achieved by a method of changing the volume of a moulding chamber in a mould string plant, said moulding chamber being delimited by a chamber bottom, a chamber ceiling provided with one or more sand filling openings communicating with a sand-feed system, two chamber side walls, a pressure plate provided with an exchangeable pressure pattern plate having a pressure pattern and being connected to a movement mechanism, a swingable plate provided with an exchangeable swing pattern plate having a swing pattern and being mounted for translational and swinging movement in order to open and close the moulding chamber, allowing the pressure plate to expel the produced moulds, wherein the method comprises the step of vertically moving the chamber ceiling and sand-feed system in unison, or the chamber bottom, or both, relative to the remainder of the moulding chamber arrangement, thereby changing the height of the moulding chamber.

In a preferred embodiment, the method further comprises the step of changing the horizontal extension of the moulding chamber in the direction between the two chamber side walls, whereby both the height and width of the produced moulds is changed.

According to an embodiment of the method, the step of changing the horizontal extension of the moulding chamber in the direction between the two chamber side walls may comprise the sub step of mounting of one or two side wall wear plates.

According to an embodiment of the method, the step of changing the horizontal extension of the moulding chamber in the direction between the two chamber side walls may comprise the sub step of changing the distance between two side wall wear plates.

According to an embodiment of the method, the step of changing the horizontal extension of the moulding chamber in the direction between the two chamber side walls may comprise the sub step of mounting of one or two side adaptor plates.

The sub step of changing the distance between the two side wall wear plates may according to a preferred embodiment of the method comprise the sub steps of:

Mounting at least one side adaptor plate on at least one of the chamber side walls of the moulding chamber, preferably two adaptor plates of equal thickness on each of the two chamber side walls, and mounting the side wall wear plates on said adaptor plates.

According to an embodiment of the method, the step of changing the distance between the two side wall wear plates comprises the step of horizontally moving the chamber side walls and side wall wear plates.

According to an embodiment, the method may further comprise the step of providing swing pattern and pressure pattern mounting plates having dimensions adapted to the possible reduced sizes of the moulding chamber.

According to an embodiment, the method may further comprise the step of closing the possible gaps between the chamber side walls and chamber ceiling and chamber bottom.

According to an embodiment of the method, the step of closing the possible gaps between the chamber side walls and chamber ceiling and chamber bottom may comprise the step of mounting or dismounting loose inserts and/or fixed extensions of wear plates.

According to an embodiment, the method further comprises the step of fixating the movable parts of the moulding chamber in the intended use positions.

According to an embodiment, the method may comprise the step of symmetrically changing the width and/or height of the produced moulds.

A second aspect of the invention pertains to a moulding chamber arrangement for a mould-string plant comprising: a moulding chamber formed by a chamber bottom, a chamber ceiling provided with one or more sand filling openings communicating with a sand-feed system, two chamber side walls, a pressure plate provided with a pressure pattern mounting plate and a pressure pattern and connected to a movement mechanism, a swingable plate provided with a swing pattern mounting plate and a swing pattern and mounted for translational and swinging movement in order to open and close the moulding chamber, allowing the pressure plate to expel the produced moulds, wherein the moulding chamber arrangement further comprises means for changing the vertical distance between the chamber ceiling and the chamber bottom.

In an embodiment according to the second aspect of the invention, said means for changing the vertical distance between the chamber ceiling and the chamber bottom is being provided in the form of a moving means for vertically moving the chamber ceiling and sand-feed system in unison, and/or the chamber bottom and mould transport arrangement in unison, relative to the remainder on the moulding chamber arrangement.

The moulding chamber arrangement for a mould-string plant may in accordance with another embodiment of the second aspect of the invention further comprise means for changing the distance between the two side wall wear plates.

According to an embodiment of the second aspect of the invention, the means for changing the distance between the two side wall wear plates comprising at least one side adaptor plate adapted to be mounted on at least one of the chamber side walls of the moulding chamber, preferably two adaptor plates of equal thickness for mounting on each of the two chamber side walls, the side wall wear plates being mounted on said adaptor plates.

According to yet another embodiment of the second aspect of the invention, the means for changing the distance between the two side wall wear plates comprises moving means for horizontally moving the chamber side walls and side wall wear plates.

The moulding chamber arrangement may in accordance with an embodiment of the second aspect of the invention further comprise swing pattern and pressure pattern mounting plates having dimensions adapted to the possible reduced sizes of the moulding chamber.

The moulding chamber arrangement may in accordance with an embodiment of the second aspect of the invention further comprise means for closing the possible gaps between the chamber side walls and chamber ceiling and chamber bottom.

Said means may according to another embodiment of the second aspect of the invention comprise loose inserts and/or fixed extensions of wear plates.

The moulding chamber arrangement may according to another embodiment of the second aspect of the invention further comprise means for fixating the movable parts of the moulding chamber in the intended use positions.

It is understood that features of one of the aspects of the invention as described above may be combined with embodiments of the other aspect of the invention in so far as they are compatible.

BRIEF DESCRIPTION OF THE DRAWINGS

In the following detailed part of the present description, the invention will be explained in more detail with reference to the exemplary embodiments of a moulding chamber arrangement for a mould-string plant according to the invention shown in the drawings, in which:

FIGS. 3A, B, C and D show different configurations of means for closing the gaps between the chamber side walls and top walls.

DESCRIPTION OF THE PREFERRED EMBODIMENTS

Figure 1:
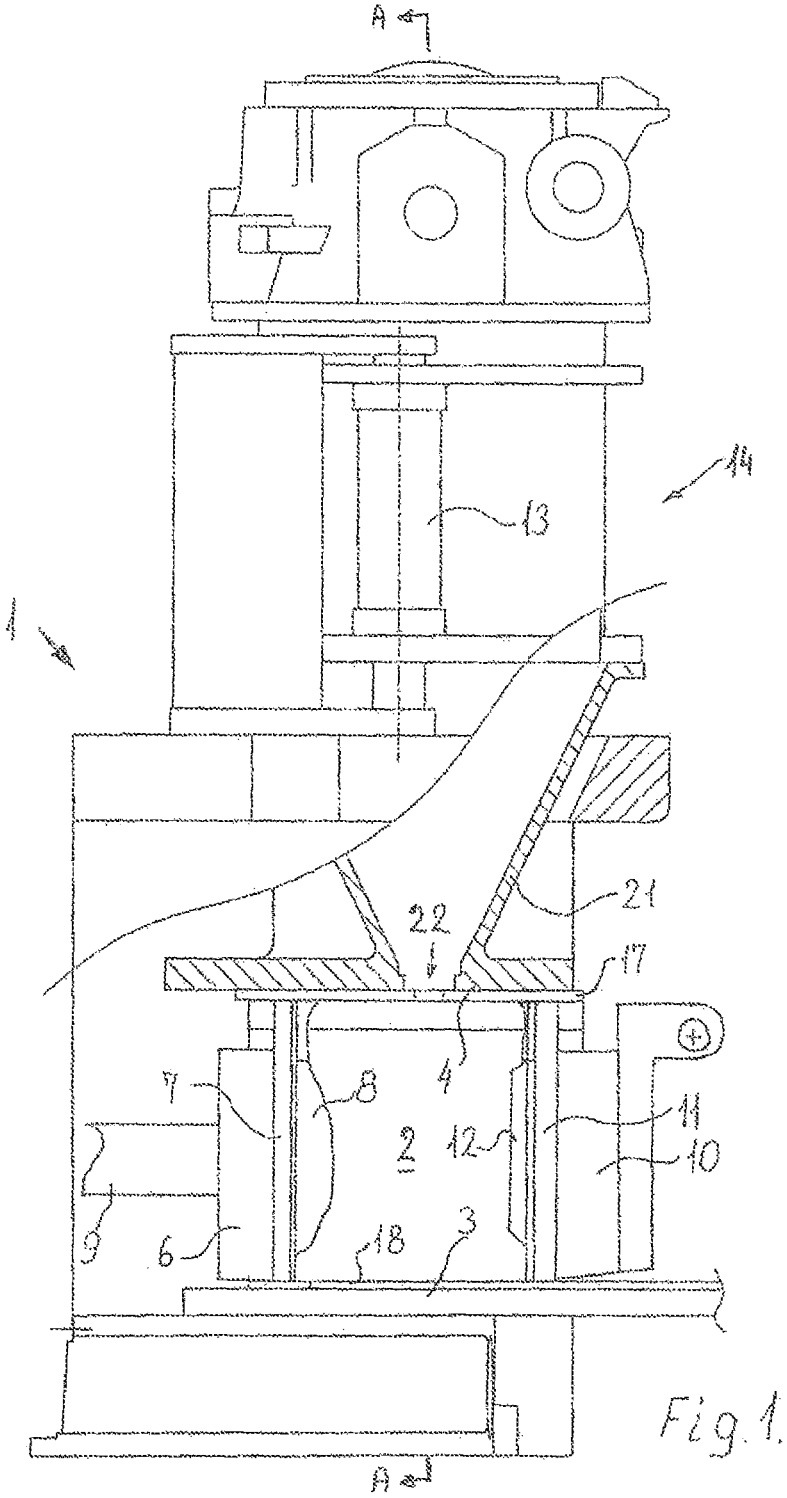
FIG. 1 schematically shows a partly cut-away side view of a moulding chamber arrangement in accordance with the present invention.

The present invention will now be described more fully hereinafter with reference to the accompanying drawings, in which exemplary embodiments of the invention are shown. The invention may however be embodied in different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout. Like elements will thus not be described in detail with respect to the description of each figure.

The moulding chamber arrangement shown in FIG. 1 comprises a sand-feed system 14 for filling sand into the moulding chamber 2, said moulding chamber 2 being delimited by two patterns 8, 12 and a chamber bottom 3 and two chamber side walls 5, 24 shown in FIGS. 2-5 and a chamber ceiling 4.

In the illustrated mould-string plant, the pressure pattern 8 is mounted on a pressure pattern mounting plate 7, which in turn is mounted on the pressure plate 6 connected to the pressure piston rod 9 for moving this combination of components in a horizontal direction for compacting the sand in the moulding chamber and for expelling the resulting sand moulds. Correspondingly, the swing pattern 12 is connected to the swing pattern mounting plate 11 mounted on the swingable plate 10, which in a well-known manner is connected to a moving mechanism for horizontal movement and swinging movement in order to be able to co-operate with the pressure pattern for compacting the sand in the mould chamber 2, and to be moved horizontally and in a swinging movement out of the way for expelling the produced moulds.

Figure 2:
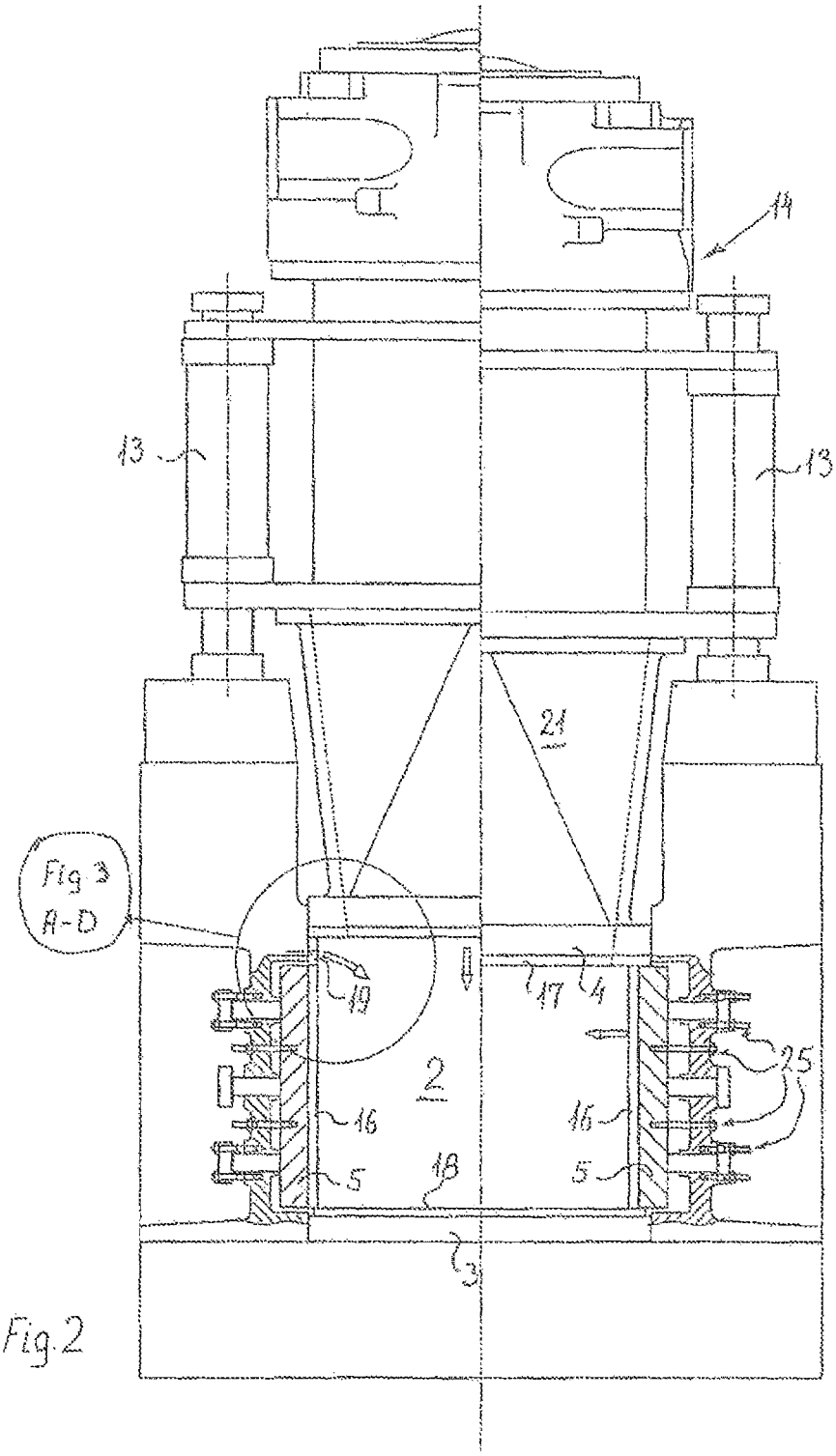
FIG. 2 shows a schematic cross section of the chamber arrangement along the line A-A in FIG. 1, showing the side and top walls in two different positions in the left-hand side and right-hand side of the figure, respectively.

As can be seen in FIG. 1 and FIG. 2, a moving means in the form of a set of hydraulic piston cylinder units 13 is provided in order to be able to move the chamber ceiling 4 with its ceiling wear plate 17 in the vertical direction, thereby changing the heights of the produced moulds. The hydraulic piston cylinder units 13 are configured for moving the combination of ceiling wear plate 17, chamber ceiling 4, sand funnel 21 and sand-filling system 14 in unison relative to the remainder of the moulding chamber arrangement 1.

In the embodiment shown in FIG. 2, a further flexibility is obtained by providing a possibility of moving the chamber side walls 5 and side wall wear plates 16 in a horizontal direction, thereby varying the widths of the produced moulds.

As shown in FIG. 2, a number of bolts and nuts 25 are provided for fixing the chamber side walls 5 in the intended use positions, and the horizontal movement of the chamber side walls 5 is guided by suitable guide rods.

Different ways of closing the potential openings in the corners of the moulding chamber are shown in FIGS. 3A-D. In FIG. 3A, an insert 19 is positioned between the side wall wear plate 16 and the chamber ceiling wear plate 17 and removed when changing the size of the moulding chamber by lowering the chamber ceiling 4 and ceiling wear plate 17 and moving the chamber side wall 5 and wear plate 16 as shown.

As shown in FIG. 3B, a corresponding removal of the insert 19 provides the possibility of moving the chamber ceiling 4 and chamber ceiling wear plate 17 vertically, without moving the chamber side wall 5 and side wall wear plate 16, thus only reducing the heights of the produced moulds without changing the widths thereof.

FIG. 3C shows how an appropriate forming of the side wall wear plate 16 to extend past the position of the chamber ceiling wear plate 17 and having an chamber ceiling 4 and chamber ceiling wear plate 17 dimensioned to pass along the side wall wear plate 16, providing the possibility of moving said chamber ceiling 4 and chamber ceiling wear plate 17 vertically along the side wall wear plate 16 in order to change the heights of the produced moulds.

In FIG. 3D it is shown how an insert 20 can be formed in order to provide the possibility of two different sizes of the produced moulds, where both heights and widths of the produced moulds are changed and where the insert 20 may be permanently installed inside the moulding chamber arrangement. In the first position shown to the left in FIG. 3D, the chamber ceiling wear plate 17 is positioned in continuation of a horizontal part of the insert 20, and correspondingly the side wall wear plate 16 is positioned in continuation of a vertical part of said insert 20. In the second position shown in FIG. 3D to the right, the two wear plates 16 and 17 are positioned adjacent.

Figure 4:
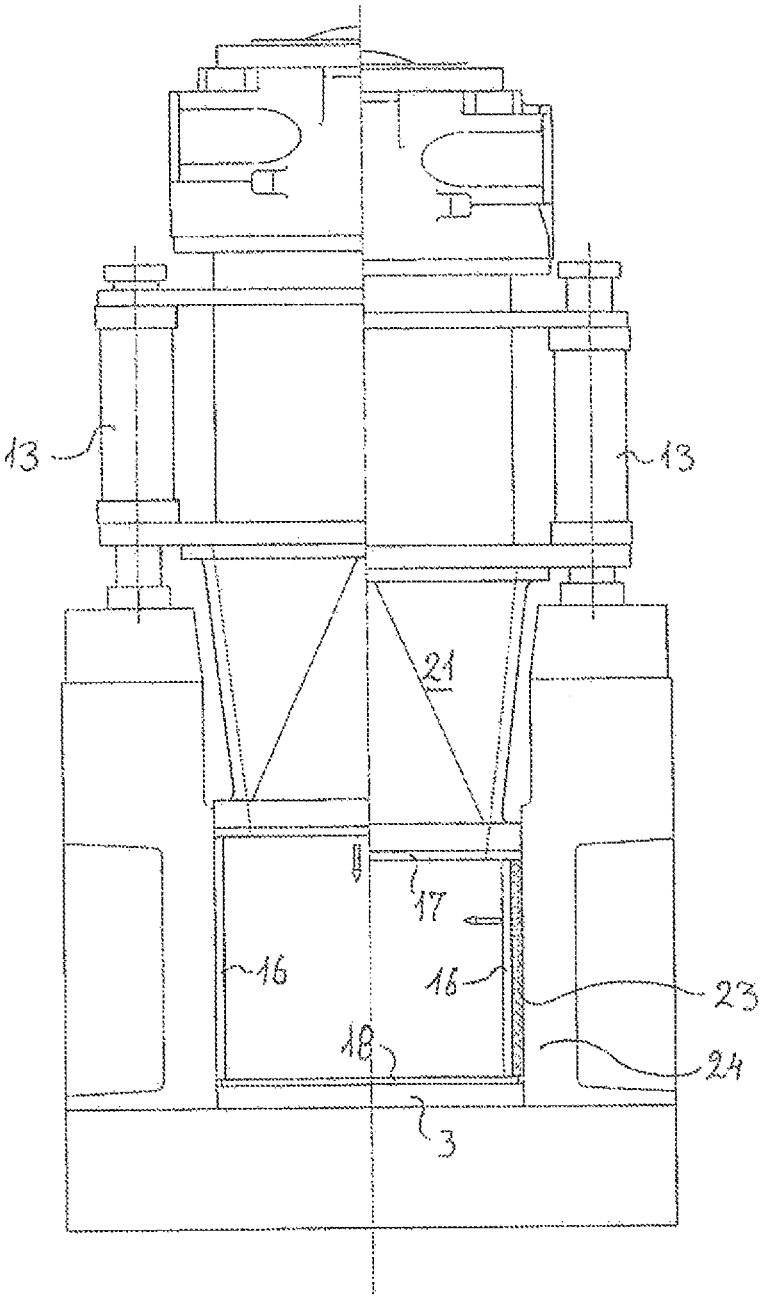
FIG. 4 shows a schematic cross section corresponding to FIG. 2, but showing an alternative embodiment using adaptor plates for changing the width of the moulding chamber.

In FIG. 4 it is shown how the widths and heights of the produced moulds can be changed, the left side of FIG. 4 showing high and wide produced moulds and the right side showing low and narrow produced moulds. To the left, the chamber ceiling 4 with wear plate 17 is positioned in an upper position, and the side wall wear plate 16 has a height corresponding to this position of the chamber ceiling wear plate 17. To the right, the chamber ceiling 4 and chamber ceiling wear plate 17 have been moved to a lower position and the side wall wear plate 16 has been replaced by an adaptor plate 23 and a side wall wear plate 16 having a height corresponding to the position of the chamber ceiling wear plate 17. Different sizes of adaptor plates 23 and corresponding side wall wear plates 16 can provide several different compositions of widths and heights of the produced moulds.

Figure 5:
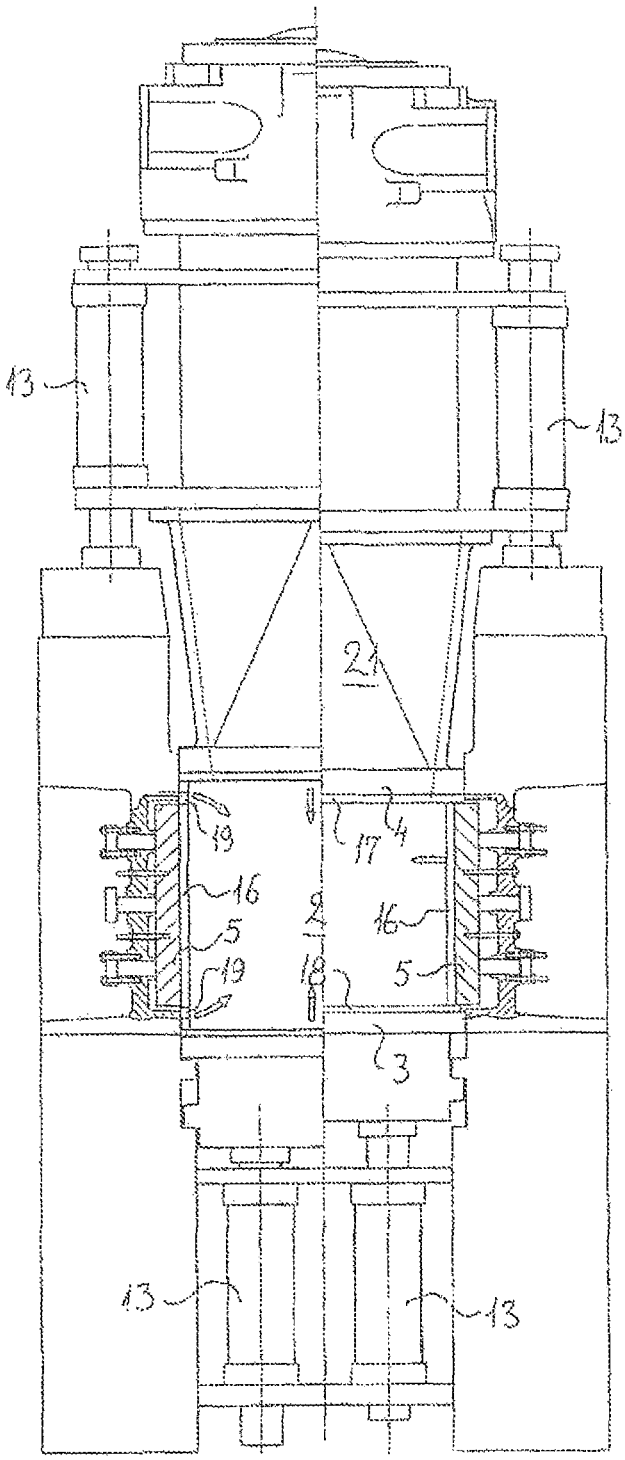
FIG. 5 shows a schematic cross section corresponding to FIG. 2 and FIG. 4, but showing an alternative embodiment, in which both top wall and chamber bottom of the moulding chamber can be moved vertically in order to change the height of the moulding chamber.

In FIG. 5, which to a major part corresponds to FIG. 2, it is shown how a further movement mechanism shown at the bottom in the form of hydraulic piston cylinder units 13 is provided to move the chamber bottom 3 and chamber bottom wear plate 18 in the vertical direction in order to change the heights of the produced moulds. As shown in FIG. 5, a removable insert 19 is provided between the side wall wear plate 16 and the chamber bottom wear plate 18 and different configurations corresponding to the FIGS. 3A to 3D can naturally be envisaged also in this connection.

Figure 6:
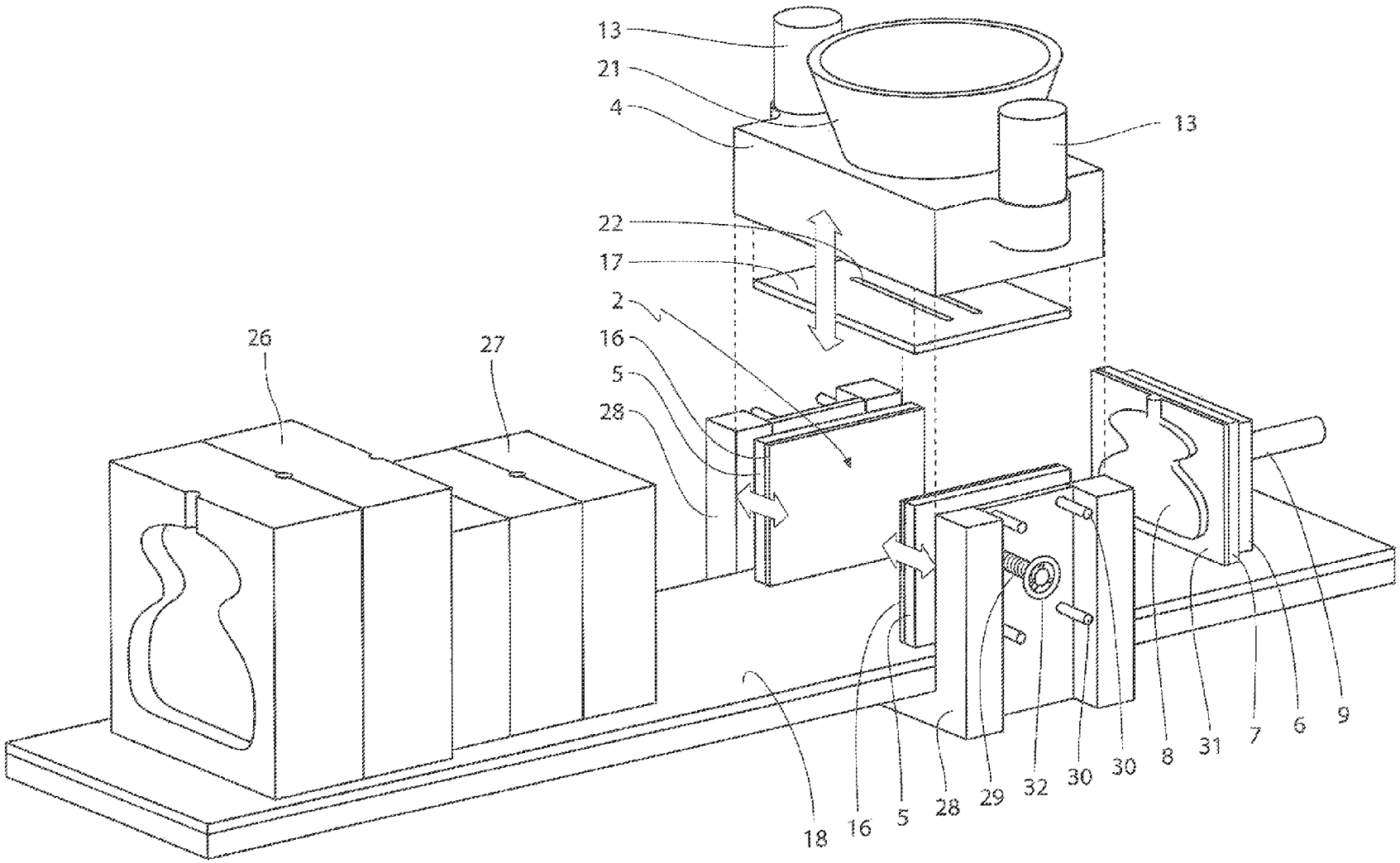
FIG. 6 shows a schematic illustration of a change from producing larger sand moulds to producing smaller moulds.

FIG. 6 shows schematically how a moulding chamber arrangement according to an embodiment of the invention can be switched from producing sand forms 26 of a larger height and width to producing sand moulds 27 of a smaller height and width. The height of the sand moulds is reduced by vertically lowering the chamber ceiling 4 and sand-feed system 14 (of which only the funnel 21 is shown) in unison relative to the remainder of the moulding chamber arrangement 1. As illustrated, a ceiling wear plate 17 is attached to the chamber ceiling 4. For illustrational purposes the ceiling wear plate 17 is illustrated apart from the chamber ceiling 4 in order to show that it is provided with one or more sand filling openings 22 providing a connection between the funnel 21 of the sand-feed system 14 (not shown) of the moulding machine and the moulding chamber 2. This ceiling wear plate 17 is attached to the chamber ceiling 4 using conventional mounting means, preferably self-locking mounting means alleviating the use of screws or bolts.

Also the chamber sidewalls 5 are equipped with a sidewall wear plate 16, which is attached to the chamber sidewall 5 using conventional mounting means, preferably self-locking mounting means alleviating the use of screws or bolts. The illustrated sidewall 5 is sometimes referred to as a so called "base plate", which in the illustrated embodiment is movable with respect to the side frame 28 of the moulding chamber arrangement 1.

In order to change the horizontal extension of the moulding chamber 2 in the direction between the two chamber side walls 5, the moulding chamber arrangement further comprises a spindle 29 and guide rods 30, which are operatively connected to the chamber side wall 5. The spindle is preferably equipped with a turning wheel (not shown). Thus, by manually turning the wheel a predetermined number of times, it is possible to adjust the width of the moulding chamber 2 very accurately. The arrangement is furthermore equipped with means for locking the chamber sidewalls 5 at the desired position in order to preclude that they will move during the very high pressures applied during the formation of the sand moulds.

The pressure plate arrangement shown in FIG. 6 comprises a pressure plate 6, on which a pressure pattern mounting plate 7 is mounted, said pressure pattern mounting plate 7 being adapted to the size of the moulding chamber 2 after the adjustment of the height and width of the moulding chamber 2. On the pressure pattern mounting plate is mounted a pressure pattern plate 31 having a pattern 8. This pressure pattern plate 31 could in one embodiment be a so called A plate mentioned earlier, while for example a so called B plate could have been used in the previous production cycle for producing the sand moulds 26. Similar changes are needed for the not illustrated swing plate arrangement when switching from producing larger sand forms to producing the smaller sand forms.

Figure 7A:
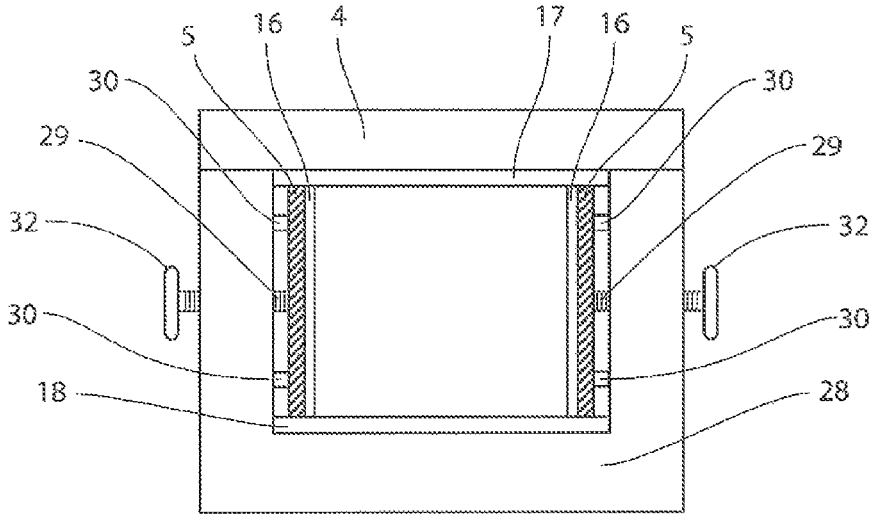
FIGS. 7A-7C illustrate schematically different ways of reducing the width of the moulding chamber.

In FIG. 7A is schematically illustrated an opening of an embodiment of a moulding chamber 2, wherein the width is reduced by moving the chamber side wall 5 (or the so called base plates 5) and the side wall wear plate 16 with respect to the side frame 28 of the moulding chamber 2. This movement is caused by manually turning the turning wheel 32, and thereby the spindle 29 to which it is connected, a desired number of turns in order to achieve the desired reduction of the width of the moulding chamber 2.

Figure 7B:
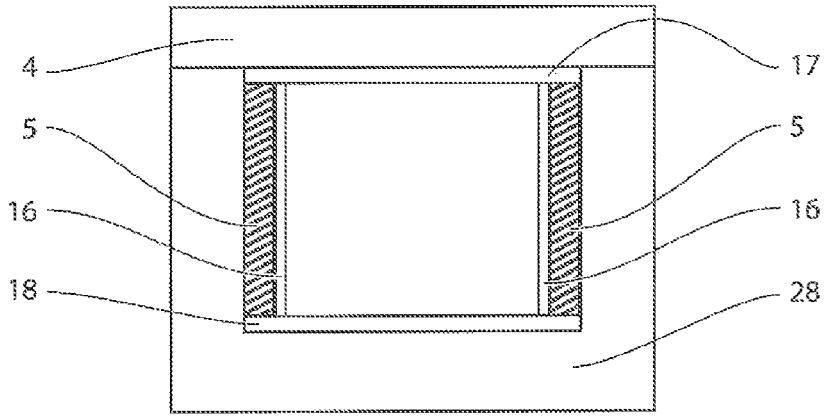

In FIG. 7B is illustrated an alternative way of reducing the width of the moulding chamber 2 by mounting a thicker chamber sidewall plate 5 (i.e. a thicker base plate 5) behind the side wall wear plate 16 in each side of the moulding chamber using the conventional mounting means, i.e. preferably self-locking mounting means, alleviating the need for screws and bolts.

Figure 7C:
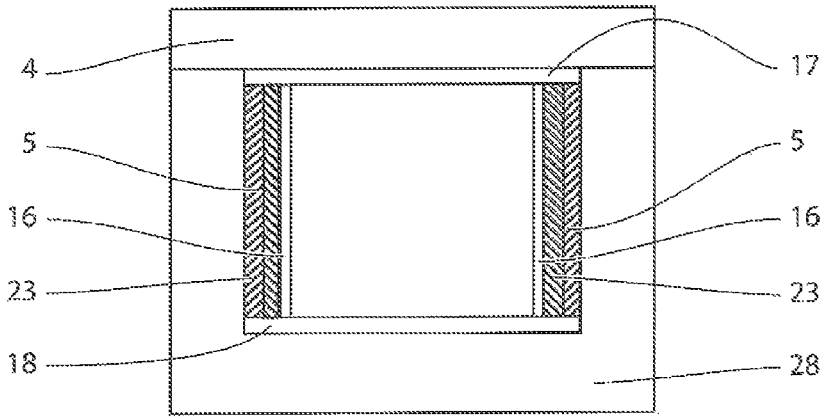

As illustrated in FIG. 7C, a set of side wall adaptor plates 23 can be used for reducing the width of the moulding chamber 2 from one standard width to another. Correspondingly, two side wall adaptor plates 23, preferably of equal thickness, are provided for installing on the chamber side walls 5 of the moulding chamber 2. The sides of the side wall adaptor plates 23 facing the mould to be produced are provided with side wall wear plates 16 mounted on the side wall adaptor plates 16 using conventional mounting means for the side wall wear plates 16. The mounting of the side wall adaptor plates 23 inside the moulding chamber 2 is preferably performed by using the mounting means for the side wall wear plates 16 for the moulding chamber 2, and this is made possible by removing the side wall wear plates 16 before inserting the side wall adaptor plates 23.

In the embodiments illustrated in FIGS. 7A-7C, the height of the moulding chamber has also been reduced to the desired size. Furthermore, in all of the embodiments schematically illustrated in FIGS. 7A-7C the width has been reduced by the same size in both sides of the moulding chamber 2. This will give a more symmetrical application of the compression force on the pressure and swing plates 6 and 10.

In general, it will be preferred to provide a symmetrical change of width and also height of the produced mould in order to maintain a correspondence between the axis of the pressure piston 9 and the gravity centre of the mould produced in the mould chamber 2 in order to avoid unsymmetrical forces in the system during compacting of the sand moulds.

Above, the invention has been described in connection with some preferred embodiments, and it will be evident for a person skilled in the art that several modifications can be performed within the scope of the following claims without departing from the general concept of the present invention. Such modifications and deviations include combining different movement mechanisms for the movement of the chamber ceiling and chamber bottom and movement mechanisms for moving the chamber side walls, and also the possibility of deviating from the above-mentioned preferred symmetrical change of the moulding chamber dimensions.

LIST OF REFERENCE NUMBERS

1 moulding chamber arrangement,
2 moulding chamber,
3 chamber bottom,
4 chamber ceiling,
5 chamber side wall, or base plate,
6 pressure plate,
7 pressure pattern mounting plate,
8 pressure pattern,
9 pressure piston rod,
10 swingable plate,
11 swing pattern mounting plate,
12 swing pattern,
13 hydraulic piston cylinder unit,
14 sand-feed system,
16 side wall wear plate,
17 ceiling wear plate,
18 chamber bottom wear plate,
19 insert,
20 insert,
21 sand funnel,
22 sand filling openings,
23 side wall adaptor plate,
24 chamber side wall,
25 bolts and nuts, movement means for moving the chamber side plate,
26 large sand forms,
27 small sand forms,
28 side frame of moulding chamber,
29 spindle
30 guiding rod,
31 pressure pattern plate, and
32 turning wheel.

The invention claimed is:

1. Moulding chamber arrangement for a mould-string plant comprising:

a moulding chamber formed by
- a chamber bottom,
- a chamber ceiling provided with one or more sand filling openings communicating with a sand feed system,
- two chamber side walls,
- a pressure plate provided with an exchangeable pressure pattern plate having a pressure pattern and being connected to a movement mechanism, a swingable plate provided with an exchangeable swing pattern plate having a swing pattern and being mounted for translational and swinging movement in order to open and close the moulding chamber, allowing the pressure plate to expel the produced moulds, means for changing the horizontal extension of the moulding chamber in the direction between the two chamber side walls, characterised by further comprising means for vertically moving the chamber ceiling and sand-feed system in unison, or the chamber bottom, or both, relative to the remainder of the moulding chamber arrangement, thereby changing the height of the moulding chamber for accommodating pattern plates of standard sizes, which wary in height as well as in width.

2. Moulding chamber arrangement in accordance with claim 1, characterized by means for only vertically moving the chamber ceiling and sand-feed system in unison, relative to the remainder of the moulding chamber arrangement, thereby changing the height of the moulding chamber.

3. Moulding chamber arrangement in accordance with claim 1, characterized by means for only vertically moving the chamber bottom, relative to the remainder of the moulding chamber arrangement, thereby changing the height of the moulding chamber.

4. Moulding chamber arrangement for a mould-string plant in accordance with claim 1, wherein the means for changing the horizontal extension of the moulding chamber in the direction between the two chamber side walls comprises mounting of one or two side wall wear plates.

5. Moulding chamber arrangement for a mould-string plant in accordance with claim 1, further comprising two side wall wear plates, and wherein the means for changing the horizontal extension of the moulding chamber in the direction between the two chamber side walls comprises means for changing the distance between the two side wall wear plates.

6. Moulding chamber arrangement for a mould-string plant in accordance with claim 1, wherein the means for changing the horizontal extension of the moulding chamber in the direction between the two chamber side walls comprises mounting of one or two side adaptor plates.

7. Moulding chamber arrangement for a mould-string plant in accordance with claim 1, characterized by comprising several sets of side adaptor plates, each set providing an individual reduced horizontal extension of the moulding chamber in the direction between the two chamber side walls.

8. Moulding chamber arrangement for a mould-string plant in accordance with claim 1, characterized by comprising several sets of side wall wear plates, each set providing an individual reduced horizontal extension of the moulding chamber in the direction between the two chamber side walls.

9. Moulding chamber arrangement in accordance with claim 5, characterised by the means for changing the distance between the two side wall wear plates comprising at least one side adaptor plate adapted to be mounted on at least one of the chamber side walls of the moulding chamber, preferably two adaptor plates of equal thickness for mounting on each of the two chamber side walls, the side wall wear plates being mounted on said adaptor plates.

10. Moulding chamber arrangement in accordance with claim 5, characterised by the means for changing the distance between the two side wall wear plates comprising moving means for horizontally moving the chamber side walls and side wall wear plates.

11. Moulding chamber arrangement in accordance with claim 1, characterised by further comprising swing pattern and pressure pattern mounting plates having dimensions adapted to the possible reduced sizes of the moulding chamber.

12. Moulding chamber arrangement in accordance with claim 1, characterised by further comprising means for closing the possible gaps between the chamber side walls and chamber ceiling and chamber bottom.

13. Moulding chamber arrangement in accordance with claim 12, characterised by said means comprising loose inserts and/or fixed extensions of wear plates.

14. Moulding chamber arrangement in accordance with claim 1, characterised by further comprising means for fixating the movable parts of the moulding chamber in the intended use positions.

15. A method of changing the volume of a moulding chamber in a mould string plant, said moulding chamber being delimited by a chamber bottom, a chamber ceiling provided with one or more sand filling openings communicating with a sand feed system, two chamber side walls, a pressure plate provided with an exchangeable pressure pattern plate having a pressure pattern and being connected to a movement mechanism, a swingable plate provided with an exchangeable swing pattern plate having a swing pattern and being mounted for translational and swinging movement in order to open and close the moulding chamber, allowing the pressure plate to expel the produced moulds, wherein the method comprises the steps of:

changing the horizontal extension of the moulding chamber in the direction between the two chamber side walls, and vertically moving the chamber ceiling and sand-feed system in unison, or the chamber bottom, or both, relative to the remainder of the moulding chamber arrangement, thereby changing the height of the moulding chamber for accommodating pattern plates of standard sizes, which wary in height as well as in width.

16. A method in accordance with claim 15, comprising the step of vertically moving only the chamber ceiling and sand-feed system in unison, relative to the remainder of the moulding chamber arrangement, thereby changing the height of the moulding chamber.

17. A method in accordance with claim 15, comprising the step of vertically moving only the chamber bottom, relative to the remainder of the moulding chamber arrangement, thereby changing the height of the moulding chamber.

18. A method in accordance with claim 15, wherein the step of changing the horizontal extension of the moulding chamber in the direction between the two chamber side walls comprises the sub step of mounting of one or two side wall wear plates.

19. A method in accordance with claim 15, wherein the step of changing the horizontal extension of the moulding chamber in the direction between the two chamber side walls comprises the sub step of changing the distance between two side wall wear plates.

20. A method in accordance with claim 15, wherein the step of changing the horizontal extension of the moulding chamber in the direction between the two chamber side walls comprises the sub step of mounting of one or two side adaptor plates.

21. A method in accordance with claim 20, wherein the sub step of changing the distance between the two side wall wear plates comprises the sub step of mounting at least one side adaptor plate on at least one of the chamber side walls of the moulding chamber, preferably two adaptor plates of equal thickness on each of the two chamber side walls, and mounting the side wall wear plates on said adaptor plates.

22. A method in accordance with claim 20, wherein the step of changing the distance between the two side wall wear plates comprising the step of horizontally moving the chamber side walls and side wall wear plates.

23. A method in accordance with claim 15, further comprising the step of providing swing pattern and pressure pattern mounting plates having dimensions adapted to the possible reduced sizes of the moulding chamber.

24. A method in accordance with claim 15, further comprising the step of closing the possible gaps between the chamber side walls and chamber ceiling and chamber bottom.

25. A method in accordance with claim 24, wherein step of closing the possible gaps between the chamber side walls and chamber ceiling and chamber bottom comprising the step of mounting or dismounting loose inserts and/or fixed extensions of wear plates.

26. A method in accordance with claim 15, further comprising the step of fixating the movable parts of the moulding chamber in the intended use positions.

27. A method in accordance with claim 15, comprising the step of symmetrically changing the width and/or height of the produced moulds.

* * * * *